United States Patent [19]

Stamm et al.

[11] 4,450,332

[45] May 22, 1984

[54] KEYSWITCH DESIGN

[75] Inventors: Russell D. Stamm; Manfred J. Wullschleger, both of El Paso, Tex.

[73] Assignee: General Instrument Corporation, New York, N.Y.

[21] Appl. No.: 411,435

[22] Filed: Aug. 25, 1982

[51] Int. Cl.[3] ..... H01H 3/12

[52] U.S. Cl. ..... 200/340

[58] Field of Search ..... 200/5 A, 159 A, 159 B, 200/159 R, 340, DIG. 1; 340/365 C; 361/288; 400/479.1

[56] References Cited

U.S. PATENT DOCUMENTS

| | | | |
|---|---|---|---|
| 540,949 | 6/1895 | Clark | 200/340 |
| 1,273,749 | 7/1918 | Demarest | 200/159 R |
| 1,934,988 | 11/1933 | May | 200/159 R |
| 3,809,838 | 5/1974 | Coppola | 200/159 R |
| 4,013,856 | 3/1977 | Joss et al. | 200/159 R |
| 4,169,974 | 10/1979 | Peers-Trevarton | 200/159 A |
| 4,227,163 | 10/1980 | Barnoski | 200/159 R |

FOREIGN PATENT DOCUMENTS

| | | | |
|---|---|---|---|
| 1018761 | 2/1966 | United Kingdom | 200/340 |
| 1361612 | 7/1974 | United Kingdom | 200/159 R |

*Primary Examiner*—John W. Shepperd

*Attorney, Agent, or Firm*—Barry R. Lipsitz

[57] ABSTRACT

An improved keyswitch assembly comprises a housing, a plunger which is spring loaded into a first position, and a channel in the housing through which the plunger can slide from the first position to a second position. A keytop is coupled to the other end of the plunger. The plunger contains a tapered shaft portion. A corresponding frustrum shaped interior portion is provided in the channel which is adapted to mate with the tapered shaft when the plunger is in the first position. This structure eliminates excessive movement of the plunger in a lateral direction within the channel. The tapered shaft portion can be fabricated with a noncircular cross-section in order to prevent rotation of the plunger within the channel. In an alternate embodiment, tapered ribs are provided on the plunger along with corresponding tapered grooves in the channel.

10 Claims, 7 Drawing Figures

FIG.1
PRIOR ART
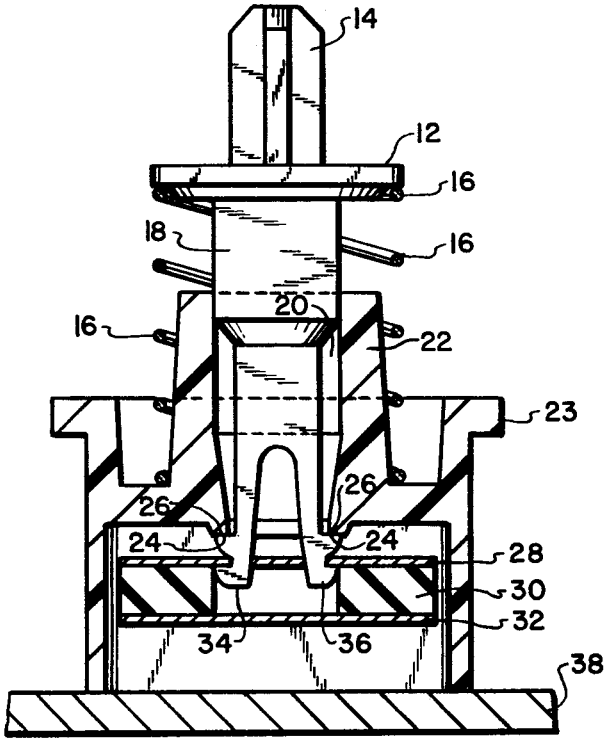
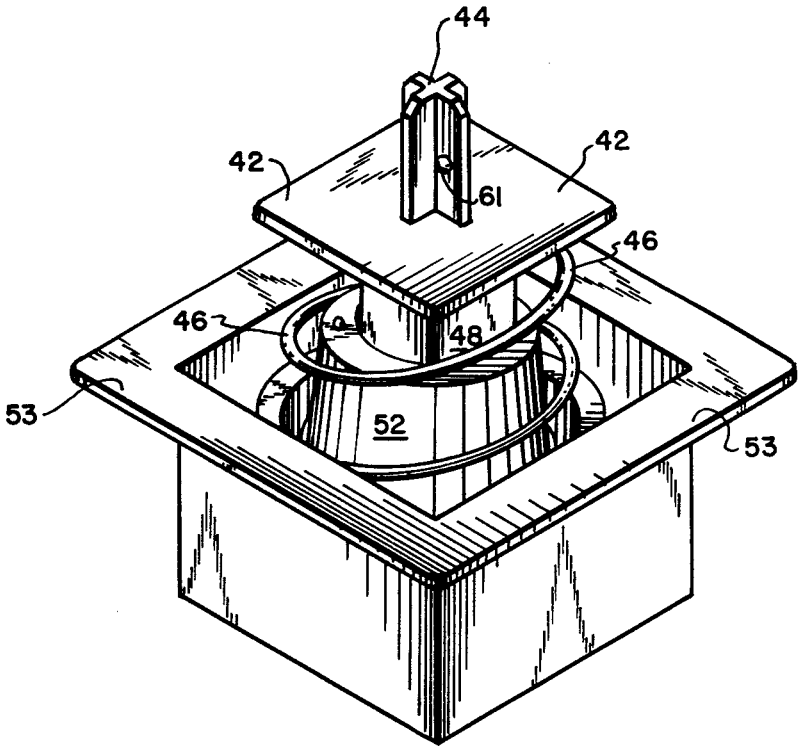
FIG.2

FIG. 5
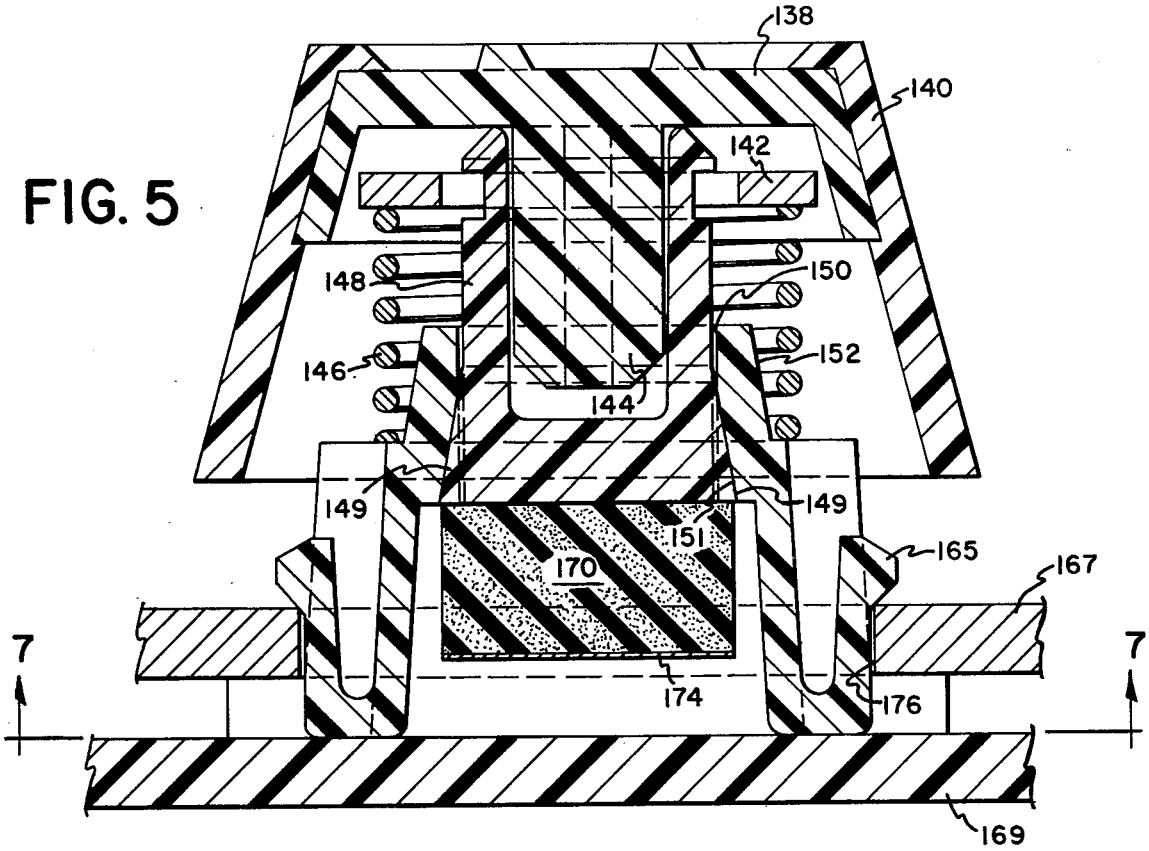
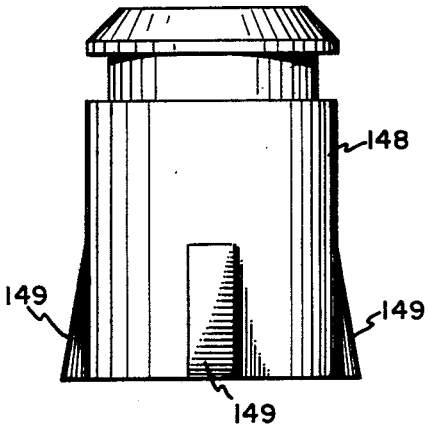
FIG. 6
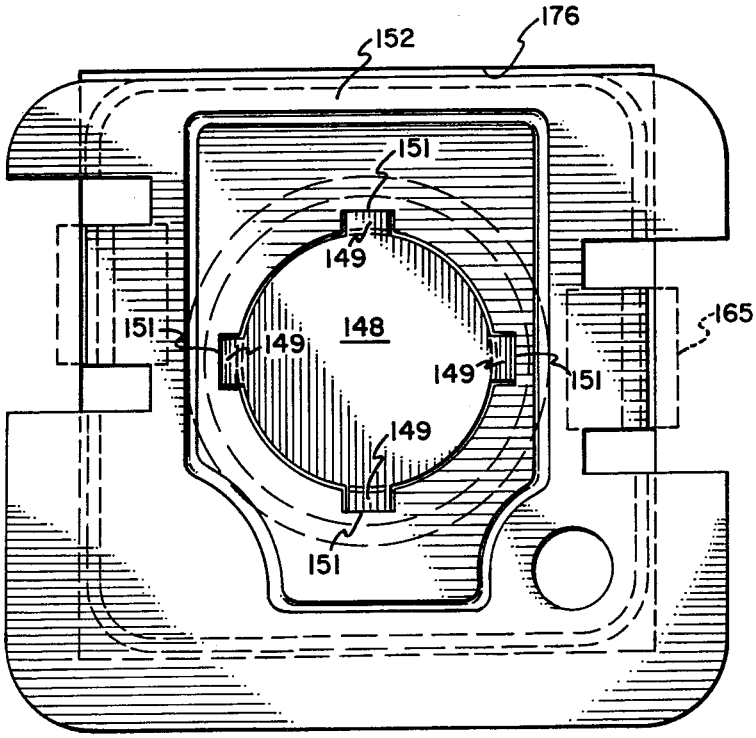
FIG. 7

KEYSWITCH DESIGN

BACKGROUND OF THE INVENTION

This invention relates generally to keyswitches for use in keyboards and more particularly to a keyswitch having a novel internal construction which provides superior alignment and stability of the key tops of such switches.

In the past, various types of keyboards have been used on typewriters, computer terminals and the like for typing or entering data into a computer. Such keyboards are typically manufactured from a plurality of separate keyswitches which are lined up on a circuit board. Each individual keyswitch has a key top thereon which is generally stamped or otherwise marked with the number or letter which that keyswitch represents. Thus, a keyboard for a conventional typewriter will have something on the order of 50 separate keyswitches, 26 of them representing the letters of the alphabet, 10 representing the digits 0–9, with additional switches for various punctuation and machine functions.

Keyswitches of conventional design generally include a plunger which is slidably mounted within a housing. The plunger is designed to slide downwardly when the key top of the keyswitch is pressed. Downward pressure on the key top actuates an electrical switch coupled to the plunger. Due to clearance between the switch housing and the plunger in keyswitches of conventional design, the key tops exhibit excessive movement in directions perpendicular to the desired downward direction of movement. Such movement results in noise, if the keyboard is shaken, and in undesirable lateral motion of the key tops. The same clearance conditions also enable the keytops to be rotated by varying amounts about the longitudinal axis of the plunger. This movement is undesirable because it results in a staggered or non-aligned condition of the key tops when viewed as a group, causing a poor cosmetic appearance of the keyboard assembly. Such rotational movement also contributes to the keyboard noise.

The above-mentioned undesirable characteristics of prior art keyboards result, in large part, from inherent tolerence variations of the plastic components (e.g. plunger, housing etc.) from which the keyswitches are manufactured. Variations in mold and die dimensions, as well as plastic material formulations and temperature parameters all contribute to such tolerance variations.

It would be advantageous to provide a keyswitch that is self aligning when in its normal, non-depressed state. Such a keyswitch should be easy to manufacture, economical, and provide a uniform appearance when a plurality of such switches are used to construct a complete keyboard. Further, such a switch should minimize lateral movement of the plunger in the switch housing, thereby reducing any keyswitch noise to a minimum. The present invention relates to such a keyswitch.

SUMMARY OF THE INVENTION

The keyswitch of the present invention comprises a housing, a channel within the housing, having a frustrum shaped interior portion, and a plunger means adapted for slidable engagement with the channel. The plunger means slides between a first position and second position and includes a tapered shaft portion which, when the plunger is in the first position, mates with the frustrum shaped interior portion of the channel. Means are provided for spring loading the plunger into the first position.

In one embodiment of the present invention, a key top is attached to one end of the plunger and a switch actuator is coupled to the other end of the plunger, with bearing means provided within the keyswitch housing for guiding the switch actuator when the plunger is moved to the second position.

The cooperation between the frustrum shaped interior portion of the housing channel and the correspondingly shaped tapered shaft portion of the plunger provides the desired self-aligning and noise reducing features of the present invention. These features are apparent when the keyswitch is in its non-depressed first position. This position is maintained, when the keyswitch is not actuated, by the spring loading arrangement.

BRIEF DESCRIPTION OF THE DRAWINGS

FIG. 1 is a cross-sectional view of a prior art keyswitch not incorporating the features of the present invention;

FIG. 2 is a perspective view of a keyswitch in accordance with the present invention;

FIG. 5 is a cross sectional view of a keyswitch in accordance with an alternate embodiment of the present invention;

FIG. 6 is a detailed view of the keyswitch plunger shown in FIG. 5; and

FIG. 7 is a plan view of the keyswitch of FIG. 5 taken substantially along the line 7—7 shown in FIG. 5, with foam pad 170 and metal foil 174 having been eliminated for the sake of clarity.

DETAILED DESCRIPTION OF THE INVENTION

Figure 3:
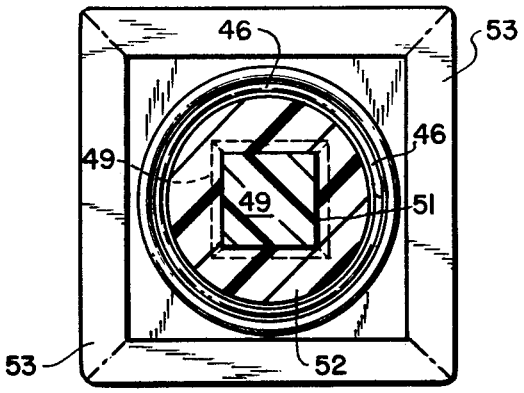
FIG. 3 is a plan view of the keyswitch of the present invention taken substantially along the line 3—3 shown in FIG. 4.

FIG. 1 shows the construction of a typical prior art keyswitch of the variety used in capacitive keyboards. Of importance to the present disclosure is not the electrical nature of the keyswitch (i.e. capacitive), but rather the mechanical structure of the keyswitch actuator assembly. The prior art keyswitch shown in FIG. 1 includes a housing 23 having a channel 20 therein which passes through collar 22. A plunger 18 is slidably engaged within channel 20. Plunger 18 has a base 12 attached to one end thereof against which one end of a spring 16 provides a force in an upward direction. Stem 14 is attached to base 12, providing a means for mounting a key top (not shown) on top of plunger 18. The other end of spring 16 bears against a portion of housing 23, with the spring surrounding collar 22.

In the particular switch shown in FIG. 1, the upward travel of plunger 18 is limited by bearing surfaces 24 and 26 which are present on plunger 18 and housing 23 respectively. Resilient fingers 34 and 36 of plunger 18 provide a snap fitting arrangement for an actuator assembly attached thereto. The actuator assembly comprises a metal plate 28 which is affixed to plunger 18. A foam pad 30 is affixed to metal plate 28 with a suitable adhesive (not shown). The actuator assembly is completed by mounting a metalized mylar sheet 32 to the outer surface of foam pad 30. The actuator arrangement shown in FIG. 1 is adapted for use in a capacitive keyboard. Those skilled in the art will appreciate that different types of actuators for different types of switching mechanisms can alternatively be attached to plunger 18.

The structure shown in FIG. 1 is intended to enable plunger 18 to be pressed downwardly by applying pressure to a key top mounted on stem 14. Spring 16 will return plunger 18 to its non-depressed condition when the downward pressure on plunger 18 is removed. In this structure, however, movement is also possible in a direction perpendicular to the desired downward direction of travel of plunger 18. Such lateral movement is possible because the fit between plunger 18 and the inner surface of collar 22 cannot be perfectly maintained without resorting to prohibitively expensive manufacturing techniques. The result is that a gap will exist between the adjacent surfaces of plunger 18 and collar 22 which allows lateral movement of plunger 18 within collar 22. Such lateral movement is undesirable from an appearance standpoint in an assembled keyboard, and is further undesirable because it produces noise when the keyboard is jarred or shaken. Further, plunger 18 in the structure shown in FIG. 1 is of circular cross section, enabling plunger 18 to rotate about its longitudinal axis within collar 22. Such rotational movement makes it impossible to maintain the key tops mounted on such switches in a keyboard assembly in perfectly aligned relationship to one another. The keytops will not be perfectly parallel with one another, resulting in a poor cosmetic appearance.

Figure 4:
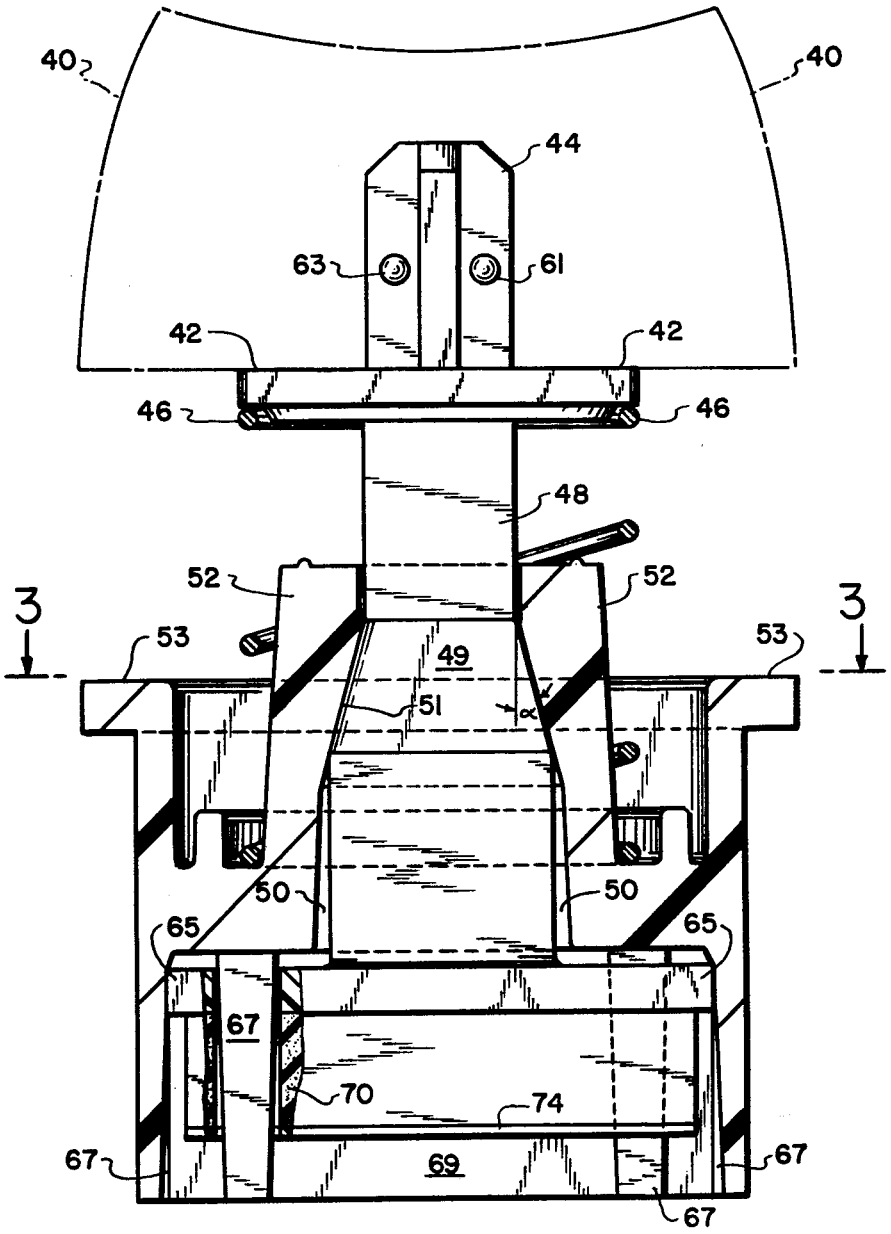
FIG. 4 is a cross sectional view of the keyswitch of the present invention.

The problems of the prior art structure are overcome by the present invention through the use of a tapered shaft portion on the switch plunger, a corresponding frustrum shaped interior portion in the switch housing channel, and the provision of a non-circular shape for at least a portion of the switch plunger. As shown in FIGS. 2 through 4, the keyswitch of the present invention comprises a housing 53 having a collar 52 with a channel 50 through which a plunger 48 passes. Plunger 48 is adapted to slide vertically within channel 50. A base 42 is attached to plunger 48 to provide a surface upon which the end of a spring 46 can bear. Base 42 could, by way of example, be in the form of a C-ring which is retained within a groove in plunger 48. Alternatively, base 42 could be a platform which snaps over stem 44 as shown in FIG. 2. Spring 46 substantially surrounds collar 52 and serves to provide a spring loading to plunger 48 so that plunger 48 will be maintained in a first position when no downward pressure is exerted upon it. A stem 44 is provided on which a key top 40 can be mounted. Projections 61 and 63 are provided on stem 44 to enable keytop 40 to be removably press-fit thereon.

Plunger 48 includes a tapered shaft portion 49. A corresponding frustrum shaped interior portion 51 in channel 50 (which channel passes through collar 52) is provided. When plunger 48 is in its first, or non-depressed condition, tapered shaft portion 49 mates with frustrum shaped interior portion 51. This mated relationship is maintained by the spring loading of spring 46. Thus, when the keyswitch is not actuated, and keytop 40 is "up," the keytop will always be properly oriented due to the mated engagement of tapered shaft portion 49 with frustrum shaped interior portion 51.

When the keyswitch is actuated, by pushing keytop 40 "down," the clearance between tapered shaft portion 49 and frustrum shaped interior portion 51 will increase, thereby facilitating the downward movement of plunger 48. The increased clearance as plunger 48 is moved downwardly is an inherent feature of the frustrum shaped design. Once the clearance is increased, the amount of force required to push the plunger down becomes somewhat reduced.

Tapered shaft portion 49 is tapered at an angle $\alpha$ with respect to the vertical. It has been found that angle $\alpha$ must be at least 16° in order to prevent plunger 48, and specifically tapered shaft portion 49, from jamming or wedging within frustrum shaped interior portion 51. As will be apparent to those skilled in the art, the smaller the angle $\alpha$, the greater will be the force required to produce any lateral movement of plunger 48 within channel 50. It has been found that there is a trade-off in selecting the angle $\alpha$. If this angle is made too small, plunger 48 will jam as noted above. However, as this angle is made larger, the likelihood that undesirable lateral movement will be possible between tapered shaft portion 49 and frustrum shaped interior portion 51 will increase. Accordingly, the selection of the angle $\alpha$ must be carefully made.

In order to prevent rotational movement of plunger 48 within channel 50, a portion of plunger 48 can be made non-circular. Thus, for example, if tapered shaft portion 49 is manufactured with a square cross-section, and frustrum shaped interior portion 51 is given a corresponding square cross section, it will be difficult to rotate plunger 48 within channel 50. Alternatively, other portions of plunger 48 can be made non-circular as will be appreciated by those skilled in the art.

In order to complete the keyswitch assembly, a switch actuator must be coupled to plunger 48. In the embodiment shown in FIG. 4, a flange 65 is provided at the base of plunger 48. A foam pad 70 is adhesively secured to flange 65 and a metal foil 74 is adhesively attached to the bottom of foam pad 70. Such an arrangement is useful for a capacitive-type keyswitch. Other types of keyswitches are well known and can be fabricated in accordance with the present invention by changing the type of actuator attached to the base of plunger 48. In the capacitive-type keyswitch embodiment shown, bearing surfaces 67 are provided in housing 53 to guide flange 65 as plunger 48 travels from its first position (non-depressed) to its second position (depressed). Bearing surfaces 67 can be fabricated by providing non-drafted surfaces in the mold or die from which housing 53 is manufactured. The remaining surfaces 69 of housing 53 adjacent flange 65 are drafted in order to facilitate the removal of housing 53 from the mold or die from which it is fabricated. In such a construction, housing 53 will typically be fabricated from plastic, as will be plunger 48 and keytop 40.

It has also been found that the mating surfaces of tapered shaft portion 49 and frustrum shaped interior portion 51 are preferably not full contact surfaces. In particular, the corner areas of tapered shaft portion 49 are preferably slightly cut off or rounded to prevent such corners from becoming wedged within the corresponding corners of frustrum shaped interior portion 51.

An alternate embodiment of the present invention is shown in FIGS. 5 through 7. In this embodiment, instead of providing tapered shaft portion 49 and frustrum shaped interior portion 51, a plurality of tapered ribs mesh with corresponding tapered grooves in the switch housing. The keyswitch shown in FIGS. 5 through 7 is a low profile type switch. It will be understood that the tapered rib configuration shown can be used on other types of keyswitches as well, and is not limited to the low profile switch shown.

Turning now to FIG. 5, a keyswitch having a keytop 140 is shown. Keytop 140 is snapped over keytop retainer 138, which includes a stud 144. Stud 144 is press-fit into an opening therefor provided in switch plunger 148. A retaining ring 142 is snapped around a groove in plunger 148 and serves as a plate upon which a spring 146 can bear. The other end of spring 146 bears against a portion of switch housing 152. Spring 146 provides a return force to the keyswitch after the keytop has been pressed downwardly.

Plunger 148 is generally cylindrical in shape, and contains a plurality of tapered ribs 149 as shown in FIG. 5, and more clearly shown in FIG. 6. Ribs 149 serve the same purpose which tapered shaft portion 49 serves in the embodiment shown in FIGS. 2 through 4. A channel 150 passes through housing 152. Within channel 150 are a plurality of tapered grooves 151 which correspond to tapered ribs 149. Thus, each tapered rib 149 fits within a corresponding groove 151 in mated relationship. When the keyswitch is not actuated, and keytop 140 is "up," the keytop will always be properly oriented due to the mated engagement of tapered ribs 149 with corresponding tapered grooves 151.

When the keyswitch is actuated, by pushing keytop 140 "down," the clearance between tapered ribs and grooves 151 will increase, thereby facilitating the downward movement of plunger 148. The increased clearance as plunger 148 is moved downwardly is an inherent feature of the tapered rib design. Once the clearance is increased, the amount of force required to push the plunger down becomes somewhat reduced.

As in the embodiments shown in FIGS. 2 through 4, it has been found that the angle of the tapered ribs must be at least 16° in order to prevent plunger 148, and specifically the tapered ribs themselves, from jamming or wedging within the corresponding tapered grooves 151. As described above in connection with the embodiment shown in FIGS. 2 through 4, the selection of the angle of taper must be carefully made.

The base of plunger 148 has a foam pad 170 adhesively secured thereto. A metal foil 174 is adhesively attached to the bottom of foam pad 170 to serve as an actuator for a capacitive-type keyswitch. It will be appreciated by those skilled in the art that the keyswitch actuator embodiment shown in FIGS. 5 through 7 can be used in keyswitches other than those of the capacitive type.

Housing 152 contains resilient flanges 165 which enable the keyswitch to be snapped into slot 176 of a mounting frame 167. Mounting frame 167 serves to secure the keyswitch in a proper position relative to a printed circuit board 169.

FIG. 7 is a cross sectional view which clearly shows the relationship between tapered ribs 149 and corresponding grooves 151. Although four tapered ribs are shown in the figures, there is no requirement that four ribs be used. Thus, a keyswitch could be manufactured using more or fewer ribs. The provision of ribs 149 serve the additional function of preventing rotational movement of plunger 148 within channel 150. Thus, plunger 148 can have a circular cross section. Channel 150, except in the areas where tapered grooves 151 are provided, can have a corresponding circular cross section.

We claim:

1. In a keyswitch comprising a housing, a plunger which is spring-loaded into a first position within said housing, a channel in said housing through which said plunger can slide from said first position to a second position, a keytop attached to one end of said plunger, and a switch actuator coupled to the other end of said plunger, the improvement comprising:

a shaft portion on said plunger which is tapered at an angle of approximately 16°; and a frustrum shaped interior portion in said channel which extends substantially along the length of said tapered shaft portion and mates therewith when said plunger is in said first position;

whereby the mating of said frustrum shaped interior portion and said tapered shaft portion aligns the plunger in the housing and minimizes the lateral movement thereof to prevent the plunger from rattling when in said first position.

2. The keyswitch of claim 1 wherein said tapered shaft portion has a non-circular cross-section.

3. The keyswitch of claim 1 wherein said switch actuator comprises a flange attached to said other end, said keyswitch further comprising bearing means within said housing for guiding said flange when said plunger is moved to said second position.

4. The keyswitch of claim 3 wherein said housing is fabricated from plastic and said bearing means comprises a plurality of non-drafted surfaces on the interior surface of said housing adjacent said flange.

5. A non-rattling keyswitch actuator assembly comprising:

a housing;

a channel within said housing;

plunger means adapted for slidable engagement within said channel between a first position and a second position, said plunger means including a shaft portion which is tapered at an angle of approximately 16°;

a frustrum shaped interior portion in said channel which extends substantially along the length of said tapered shaft portion and mates therewith when said plunger means is in said first position; and means for spring loading said plunger means into said first position;

whereby the mating of said frustrum shaped interior portion and said tapered shaft portion aligns the plunger means in the housing and minimizes the lateral movement thereof to prevent the plunger means from rattling when in said first position.

6. The keyswitch of claim 5 wherein said tapered shaft portion has a non-circular cross-section.

7. The assembly of claim 5 wherein said plunger means has a top end adapted to receive a key top thereon and a bottom end adapted to actuate a switch.

8. In a keyswitch comprising a housing, a plunger which is spring-loaded into a first position within said housing, a channel in said housing through which said plunger can slide from said first position to a second position, a key top attached to one end of said plunger, and a switch actuator coupled to the other end of said plunger, the improvement comprising:

a plurality of tapered ribs on said plunger; and a plurality of tapered grooves in said channel adapted to mate with said tapered ribs when said plunger is in said first position;

wherein said ribs are tapered at an angle of approximately 16°.

9. A keyswitch actuator assembly comprising:

a housing;

a channel having a plurality of tapered grooves within said housing;

plunger means adapted for slidable engagement within said channel between a first position and a second position, said plunger means including a plurality of tapered ribs for mated engagement with said grooves when said plunger means is in said first position; and means for spring loading said plunger means into said first position;

wherein said ribs are tapered at an angle of approximately 16°.

10. The assembly of claim 9 wherein said plunger means has a top end adapted to receive a key top thereon and a bottom end adapted to actuate a switch.

* * * * *